US006371340B1

(12) United States Patent
Pateman et al.

(10) Patent No.: US 6,371,340 B1
(45) Date of Patent: Apr. 16, 2002

(54) DISPENSING CLOSURES

(75) Inventors: David Dennis Pateman, Leicester; Christopher Paul Ramsey, Oxfordshire, both of (GB)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 09/831,732

(22) PCT Filed: Nov. 12, 1999

(86) PCT No.: PCT/GB99/03788

§ 371 Date: May 15, 2001

§ 102(e) Date: May 15, 2001

(87) PCT Pub. No.: WO00/29296

PCT Pub. Date: May 25, 2000

(30) Foreign Application Priority Data

Nov. 17, 1998 (GB) ..... 9825121

(51) Int. Cl.[7] ..... B65D 25/40
(52) U.S. Cl. ..... 222/494
(58) Field of Search ..... 222/490, 494, 222/493, 496, 541.9, 547

(56) References Cited

U.S. PATENT DOCUMENTS 5,115,950 A * 5/1992 Rohr ..... 222/490
5,531,363 A * 7/1996 Gross et al. ..... 222/494
5,839,626 A * 11/1998 Gross et al. ..... 222/494
6,213,355 B1 * 4/2001 Schwanenberg ..... 222/494

* cited by examiner

*Primary Examiner*—Philippe Derakshani
*Assistant Examiner*—Thach H Bui
(74) *Attorney, Agent, or Firm*—Diller, Ramik & Wight

(57) ABSTRACT

A dispensing closure for a liquid product such as a liquid soap has a self-closing valve (12, 112) having a mounting ring (20, 120) and a dispensing head (24, 124) attached to the mounting ring by a generally cylindrical connecting wall (22, 122). The valve is located in the dispensing aperture (68, 168) of a closure body (10, 110, 110') so as to form a seal against product escape. Retention of the mounting ring in its sealing position is provided by a resilient clamping ring (80, 180) of the closure body, which is turned inwardly against the mounting ring by means of a three-part mandrel (90).

16 Claims, 4 Drawing Sheets

DISPENSING CLOSURES

BACKGROUND OF THE INVENTION

This invention relates to dispensing closures of the kind which have a self-closing valve, and to methods of assembling such closures. By self-closing valve is meant an essentially unitary valve which is moulded from an elastomeric material and which in use opens in response to an elevated pressure created in an associated liquid product, and closes again automatically and in a self-sealing manner when the pressure is subsequently reduced to ambient pressure. Self-closing valves have been proposed for use with a wide variety of liquid foods e.g. ketchups, and household products e.g. washing-up liquids.

It is well known to provide a dispensing closure with a self-closing valve which is a unitary component formed basically of three parts, namely (a) a dispensing head formed with a dispensing opening capable of self-reclosure after a dispensing operation, (b) a mounting ring by which the valve as a whole can be mounted in a closure body, and (c) a connecting wall connecting the head and the ring to one another.

The dispensing head and usually also the connecting wall is required to be flexible in order to perform its desired functions. Being of the same, relatively thin, material as the head and the wall, the mounting ring will itself be subject to distortion in response to the substantial forces which may be imposed upon it during dispensing. It is nevertheless required to make a secure seal with the closure body against leakage of product.

In the dispensing closures with self-closing valves which have met commercial success hitherto, the mounting ring has been secured in the closure by means of two components of the closure body which are snap-engaged together so as to hold the mounting ring between them in a sealing manner. However, although such arrangements have been satisfactory in terms of their operating performance, they have had a high manufacturing cost arising from the three components and the need to assemble them together. In some arrangements the mounting ring has been bonded or otherwise attached to a support ring prior to assembly in the closure, and this has further increased the cost of manufacture.

SUMMARY OF THE INVENTION

The present invention seeks to enable a self-closing valve to be secured in a closure in a manner which combines low manufacturing cost with high seal integrity. Accordingly from one aspect thereof the invention provides a method of securing a self-closing valve having a mounting ring in the assembly of a dispensing closure, the method being characterised by the following steps:

a) providing the closure body with a downwardly directed abutment face surrounding a dispensing aperture in which the valve is to be located, and a generally cylindrical skirt dimensioned to accept the mounting ring and extending downwardly of the closure to a free edge axially spaced from the abutment face, a portion of the skirt including the free edge being inwardly deformable;

b) providing the mounting ring of the self-closing valve with an upwardly directed abutment face engageable with the abutment face of the closure body;

c) entering the valve into the skirt of the closure body with the abutment faces in opposition; and d) inturning the deformable portion of the skirt against the mounting ring so that it holds the mounting ring with the abutment faces in mutual abutment and with the closure body and the valve in sealing relation. Preferably a seal between the closure body and the valve is provided at the interface of the abutment faces.

From a second aspect the invention provides a dispensing closure on or for a container, which comprises a closure body having a dispensing aperture, a downwardly directed abutment face surrounding the aperture, and a generally cylindrical skirt extending downwardly of the closure to a free edge spaced from the abutment face, the closure further comprising a self-closing valve having a mounting ring formed with an upwardly directed abutment face, the valve being received within the skirt with its abutment face abutting the abutment face of the closure body and held there by an inturned and resilient portion of the skirt including the free edge thereof, the closure body and the valve being disposed in sealing relation preferably at the abutment faces.

In the two preceding paragraphs the inturning of the free edge portion of the closure body skirt is preferably done by a mandrel, possibly heated and possibly formed of two or more relatively movable parts, which is brought into engagement with the closure body skirt after the valve has been inserted into the skirt. As an alternative, however, one or more rollers which are moved progressively around the circumference of the free edge portion may be used.

In order that the invention may be better understood two dispensing closures and a method of assembling them in accordance with the invention will now be described by way of example, with reference to the accompanying drawings which in which:

DESCRIPTION OF THE PREFERRED EMBODIMENTS

Figure 1:
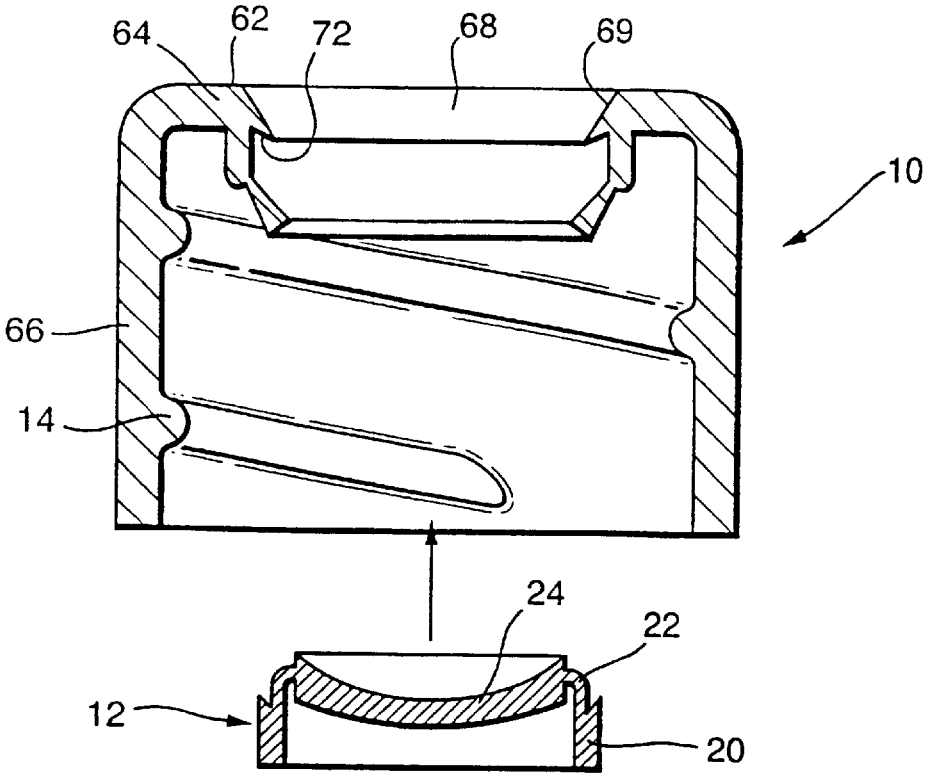
FIG. 1 is an exploded view of the first closure prior to assembly and as seen in central vertical section.

In FIGS. 1 to 4 of the drawings the reference numeral 10 indicates a closure body, the reference 12 denoting a self-closing valve which is assembled to the body in accordance with the teachings of the invention to form a screw closure.

The assembled closure is adapted to be attached to the neck of an associated squeeze bottle (not shown) containing a liquid product such as a liquid soap. For that purpose the closure body 10 has a screw thread 14 (FIG. 1). The body may be moulded from a standard thermoplastics polymer such as polyethylene or polypropylene.

The drawings show the closure in its orientation when the associated bottle is stood upright on a horizontal surface. Thus the dispensing direction of the bottle is upward as shown, and throughout the specification and claims the words "upward" ("upper") and "downward" ("lower") have generally been used to denote, respectively, the exterior and interior of the closure in relation to the packaged product. The words "inward" ("inner") and "outward" ("outer") are correspondingly used in the radial sense.

The self-closing valve 12 is an integral moulding of a thermoplastic elastomer (TPE), or of liquid silicon rubber such as is sold in UK by Bayer under the trade name SILOPREN. It is circular when viewed in plan view and has three parts, namely a mounting ring 20 which forms a continuous marginal region around the valve, a Although a preferred embodiment of the invention has been specifically illustrated and described herein, it is to be understood that minor variations may be made in the apparatus without departing from the spirit and scope of the invention, as defined by the appended claims. central valve head 24, and a tubular connecting wall 22 joining the mounting ring to the valve head.

The mounting ring 20 is vertically elongate, having radially inner and outer generally cylindrical faces 26 and 28. Its radial thickness is greater than that of the connecting wall 22, which extends upwardly from its inner periphery. Radially outside the connecting wall the mounting ring has an inclined shoulder forming an abutment face 30 which extends generally upwardly and outwardly as shown for the purpose which will later become apparent. A rectangular-section groove 31 may, as shown, be formed around the inner face 26 to facilitate demoulding. The bottom free edge of the mounting ring is annular, and denoted by the reference numeral 93 in FIG. 3.

The valve head 24 is concave to the exterior of the closure and is of progressively reducing thickness in the direction of its centre line XX (FIGS. 2,4) from the cylindrical face 40 which forms its outer periphery. Its exterior face 42 is arcuate, as is its interior face 48. The faces 40, 42 of the valve head converge to a sharply defined circular free edge 50 which forms the topmost point of the valve head as shown.

The valve head 24 is formed with two identical straight cuts 52A, 52B which intersect at their midpoints on the centreline XX. The cuts are orthogonal to one another and each cut extends through the thickness of the valve head. In combination the cuts therefore form four individually movable tongues attached to the valve head along the sides of a square and having their apices coincident on the centreline. One such tongue 53 is visible in full in FIGS. 2 and 4.

The connecting wall 22 has inner and outer substantially cylindrical surfaces 54 and 56, of which the inner surface 54 generally forms an upward continuation of the inner surface 26 of the mounting ring 20. At its upper end the connecting wall is connected to the cylindrical outside face 40 of the valve head 22 at a radially extending, short and thin, inturned flange 60 which is typically of 0.3 mm thickness.

The flange 60 is attached to the side face 40 of the valve head at a spacing below the top free edge 50 of the valve head. The part of the valve head lying above the flange and including the free edge 50 accordingly defines an upwardly tapering and relatively compliant lip 59 which is capable of promoting drip-free product flow and of forming a product-tight seal against a flat surface of a travel cap (not shown) if required. For this purpose, and as can be seen in particular in FIG. 3, the lip projects above the surrounding and plane upper surface 62 of the closure body 10.

The connecting wall 22 is substantially thicker than the flange 60, and the flange forms a hinge of low flexural stiffness by which the valve head 24 is attached to the connecting wall.

The closure body 12 has a generally plane crown 64 which is formed with the upper surface 62. A peripheral skirt 66 (FIG. 1) surrounds and is dependent from the crown, and carries the screw thread 14.

Figure 3:
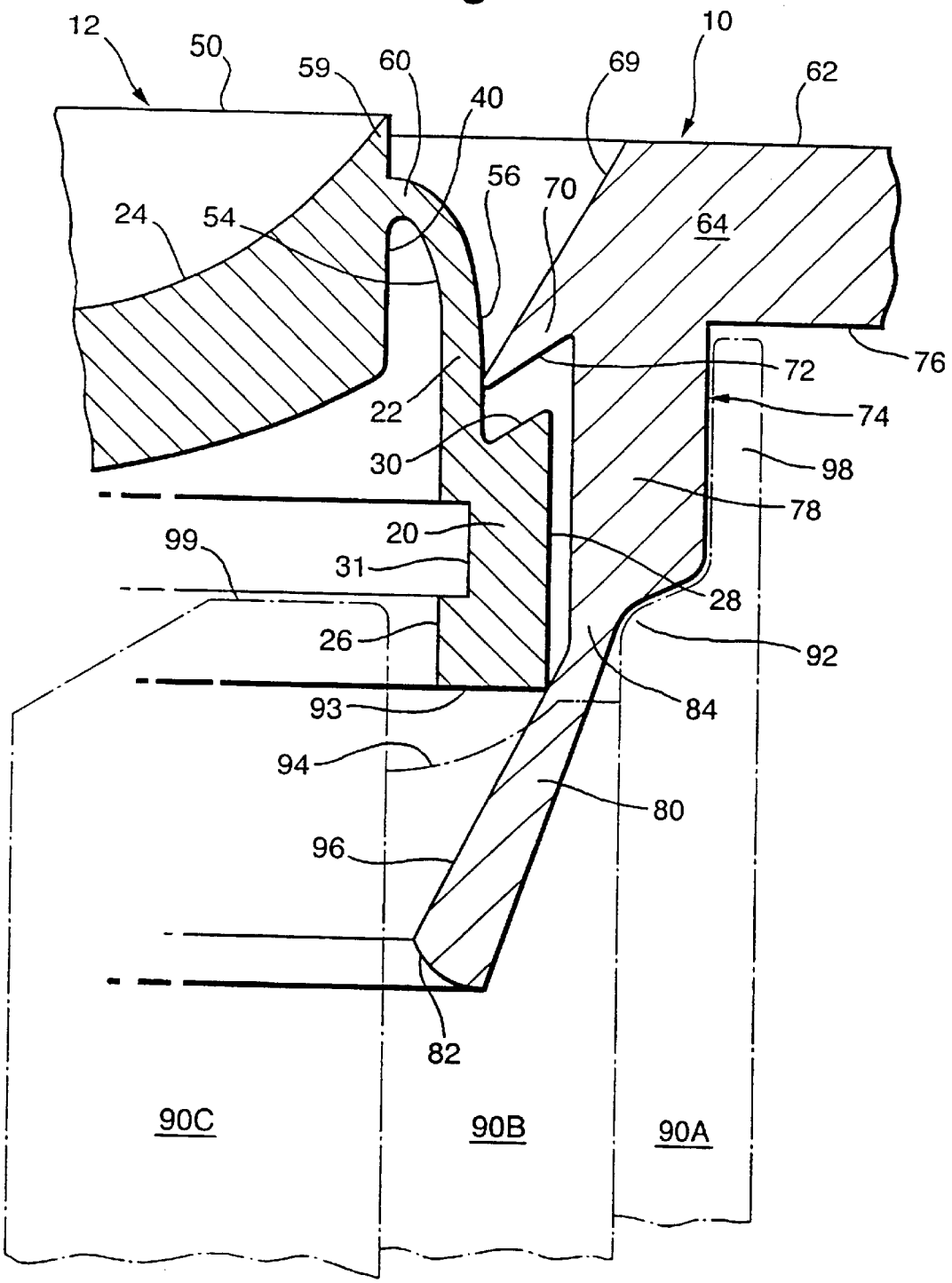
FIG. 3 shows part of FIG. 2 on a greater scale and in relation to a three-part mandrel by which a clamping ring forming part of a skirt of the closure body of the first closure is deformed inwardly around the mounting ring of the self-closing valve.

Referring in particular to FIG. 3, the crown 64 is formed with a circular dispensing aperture 68 in which the self-closing valve 12 is mounted. The aperture is defined by a frustoconical, downwardly and inwardly extending, face 69 the bottom end of which is provided by the upper face of a downwardly and inwardly extending lip 70. The lip tapers in thickness towards its free edge, and has a lower shoulder forming an abutment face 72 which is complementary to the abutment face 30 of the self-closing valve.

A tubular skirt 74 projects from the undersurface 76 of the crown 64 around the lip 70. An upper part 78 of this skirt is cylindrical and substantially rigid, having an internal diameter and length to accept and receive the mounting ring 20 of the self-closing valve 12. Below its upper part the skirt terminates in a clamping ring 80 of which the thickness, substantially less than that of the upper part, increases progressively towards its free edge 82.

At its upper end the clamping ring 80 has a film hinge 84 of, typically, 0.3 mm thickness by which it is attached to the upper part 78 of the skirt. The film hinge enables the clamping ring to be moved to an infolded position as will be described.

Figure 2:
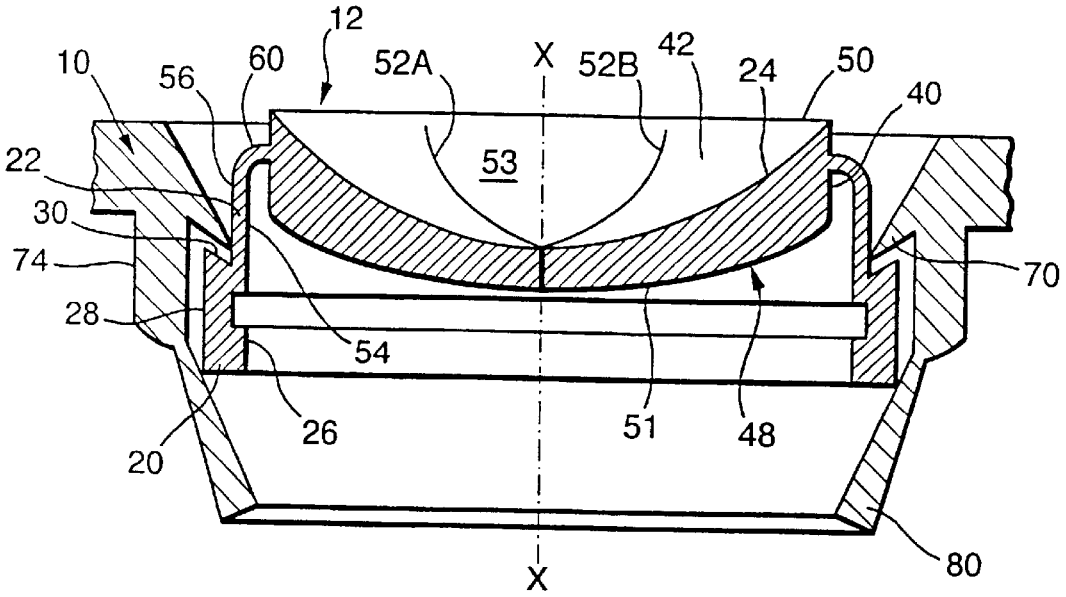
FIG. 2 is an enlarged scrap view of the first closure at an intermediate stage in its assembly.

FIGS. 1 to 3 show the clamping ring 80 in the asmoulded condition of the closure body 10, and it will be seen to be inclined downwardly and, through a small angle, inwardly after ejection from the injection mould in which it is formed. For the assembly of the closure the self-closing valve 12 is pushed upwardly (in relation to the closure body) through the opening formed by the clamping ring 80, until it adopts the relative position shown in FIGS. 2 and 3. After insertion, the lip 70 and the clamping ring 80 resiliently hold the valve captive in the closure body 10 so that the closure can be safely transferred between successive assembly operations. In an alternative method of assembly the valve is fitted into the closure body by movement in the downward direction as shown past the lip 70.

To complete the assembly of the closure a mandrel having three relatively movable parts 90A, 90B and 90C is operated as described below, so as to turn the clamping ring in and around the free edge 93 of the mounting ring 20, with hinging at the film hinge 84. The clamping ring is endless, and during its inward and upward movement it therefore suffers circumferential compression with some distortion. However, once it passes a substantially plane condition (i.e. horizontal as shown) it is able to expand into firm resilient contact with the inside face 26 of the mounting ring. The mounting ring therefore becomes firmly clamped against the substantially rigid upper part 78 of the closure body skirt 74.

Figure 4:
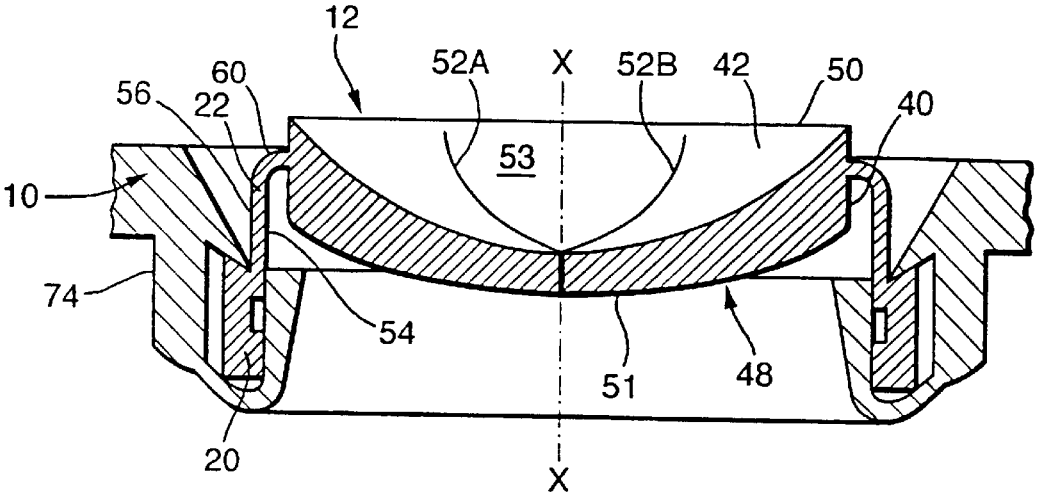
FIG. 4 is a view similar to FIG. 2 and showing the first closure when assembled.

As it moves inwardly and upwardly the clamping ring 80 engages the bottom of the mounting ring 20 at its own inner surface 96, and so lifts the valve 12 as a whole until the abutment faces 30, 72. come into engagement and further upward movement is prevented. This occurs at approximately the same time as the clamping ring engages the face 26; as illustrated in FIG. 4, therefore, the mounting ring becomes firmly and resiliently held by the skirt 74, with its shoulder 30 abutting the abutment face 72 of the closure body to form a seal against product escape.

FIG. 3 shows the three parts 90A, 90B and 90C of the mandrel 90 in their uppermost positions in relation to the closure, it being understood that they are lifted to this position from a lower, retracted position (not shown) in which they are each out of engagement with the closure.

The mandrel parts are lifted in succession against the closure so as to effect the inward and upward folding of the clamping ring 80. The parts are telescopically arranged, with the part 90A outermost and the part 90C innermost.

The outer part 90A of the mandrel is the first to engage the closure. It plays no part in the folding operation as such, but provides external support for the skirt 74 while folding is taking place. For that purpose it has a cylindrical free end portion 98 sized to closely surround the upper portion 78 of the skirt. Below the free end portion it has a nose 92 which is shaped to snugly engage the outside of the skirt at the film hinge 84, so as to resist buckling of the skirt in this locality.

After the outer mandrel part has been raised to its supporting position the intermediate, second part 90B of the mandrel is lifted into engagement with the free edge 82 of the clamping ring 80. It has a contoured upper face 94 by which it moves the clamping ring inwardly and upwardly to lie at an angle of about 30° below the horizontal. The inner mandrel part 90C then takes over, engaging the clamping ring by its upper face 99 and so lifting the clamping ring through the horizontal until it is able to expand resiliently of its own accord against the inner face 26 of the mounting ring. The mandrel parts 90A, 90B, 90C are then lowered again to their retracted positions in readiness for the next closure.

Whilst not illustrated in the drawings, it may be desirable to arrange for the inner mandrel part 90C to engage the underside of the valve head 24 so as to assist the upward movement of the valve in relation to the closure body 10. If required, this function may alternatively be provided by a fourth part of the mandrel disposed telescopically within the part 90C.

Whilst it is generally preferred for the clamping ring 80 to be circumferentially continuous, in a possible modification the ring is made discontinuous by a slit or slits formed in it at one or more locations of its circumference. The slit or slits facilitate the operation to turn the clamping ring inwardly and upwardly to its clamping position, but they reduce the clamping pressures which the ring is capable of exerting. Nevertheless, they are small in number, e.g. one, two, three or four, and each ring segment which they create is of sufficient angular extent to generate and maintain a required clamping force in its own right.

For use, the assembled closure is fitted to a squeezable bottle (not shown) of a liquid product. A travel cap may be fitted over the closure and arranged to make sealing engagement with the frustoconical face 68 and/or upper face 62 of the closure body 10 and with the lip 59 of the self-closing valve 12. Also it may be convenient to arrange for the upper part 78 of the skirt 74 to act as a spigot seal for sealing within the bottle neck.

When the bottle is inverted and squeezed, the increased pressure of product separates the tongues 53 in well known manner to allow dispensing. By virtue of the orientation of the abutment faces 30, 72 the increased product pressure also has the effect of increasing the contact pressure at the interface between them, with the result that the security of the seal which is formed at the interface in enhanced generally in correspondence with the product pressure. After dispensing, the bottle is released and the tongues 53 eventually regain the positions shown so as to reseal with one another as desired.

The mandrel 90 may be used cold (i.e. at ambient temperature) but for some applications of the invention it may be preferred to heat it. In a modified method of assembly the mandrel is replaced by a roller or series of rollers (cold or heated), by which the clamping ring 80 is progressively infolded to its desired position against the mounting ring 20.

Figure 5:
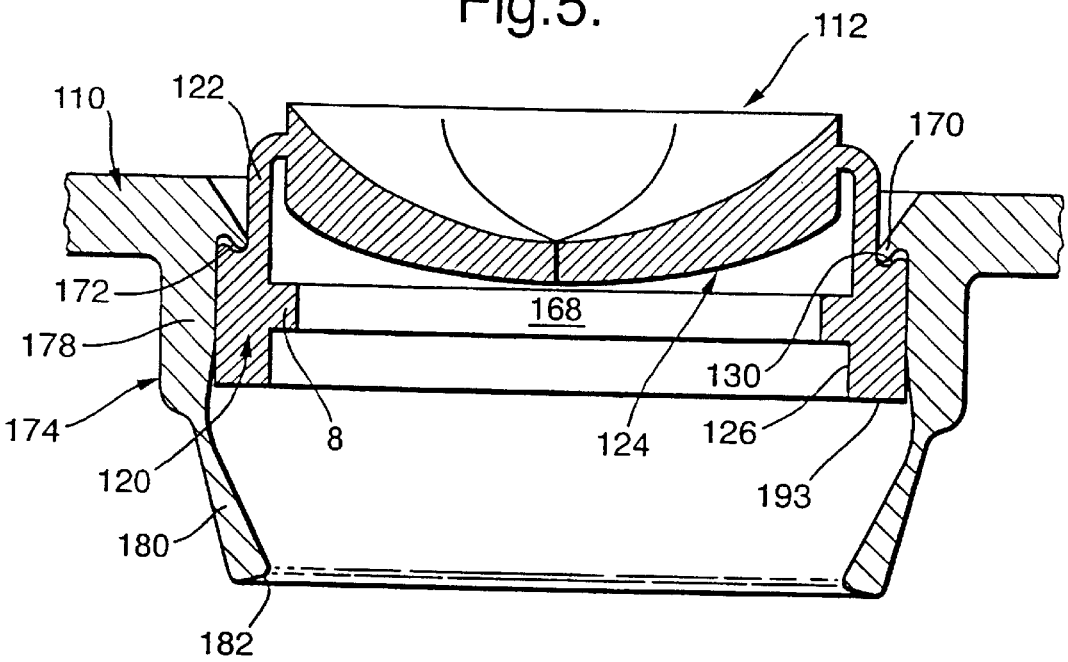
FIG. 5 is a view generally corresponding to FIG. 2 of the second closure.
Figure 6:
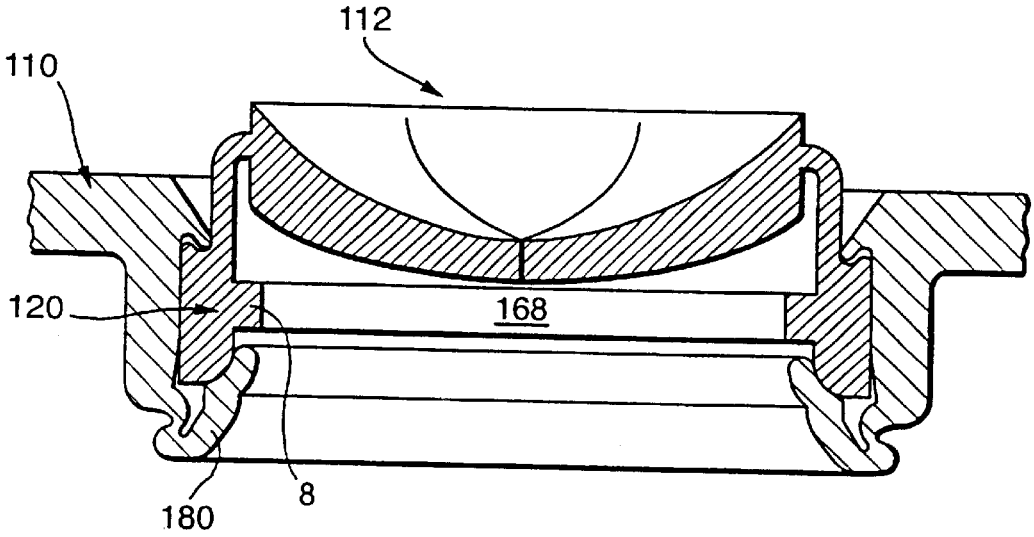
FIG. 6 shows the second closure in a view generally corresponding to FIG. 4.

FIGS. 5 and 6 show a further closure embodying the invention. The closure has many similarities to the closure of FIGS. 1 to 4, and for clarity the same reference numerals as before, prefixed with the number 1, are used to indicate like or analogous parts.

In this second embodiment the mounting ring 120 of the closure valve 112 is formed with an inward projection 8 of rectangular cross-section which extends continuously around its interior surface at approximately the position of the groove 31 in the first embodiment. The projection 8 assists in demoulding the valve after moulding, and ensures easy separation of the valves, for example in a rotary feeder, for assembly.

A further difference between this second embodiment and the first lies in the engagement of the clamping ring 180 of the closure body 110 with the mounting ring 120 of the valve 112. In this embodiment the engagement occurs primarily at the bottom inside corner of the mounting ring.

It will furthermore be understood from FIG. 5 that the mounting ring 120 is a size-for-size (push) fit within the upper part 178 of the closure body skirt 174. The cylindrical interface formed at this engagement is able to form a seal against product escape during dispensing, when the mounting ring expands radially in response to product pressure inside it. This seal may be additional or alternative to a seal made at the inclined interface of the closure body lip 170 and the shoulder 130 of the mounting ring as described above. As with the previous embodiment it is preferred for the mounting ring to have no chamfer at either of its bottom corners. In this way the width of the bottom face 93, 193 of the mounting ring can be maximised to facilitate ejection from the mould by a stripper plate.

Further or alternative sealing against product escape from the closures shown and described may be provided at the tip of the body lip 17, 170 where it engages the connecting wall 22, 122 of the valve 12, 112. For this purpose the lip may make an interference fit with the outer surface of the connecting wall.

Figure 7:
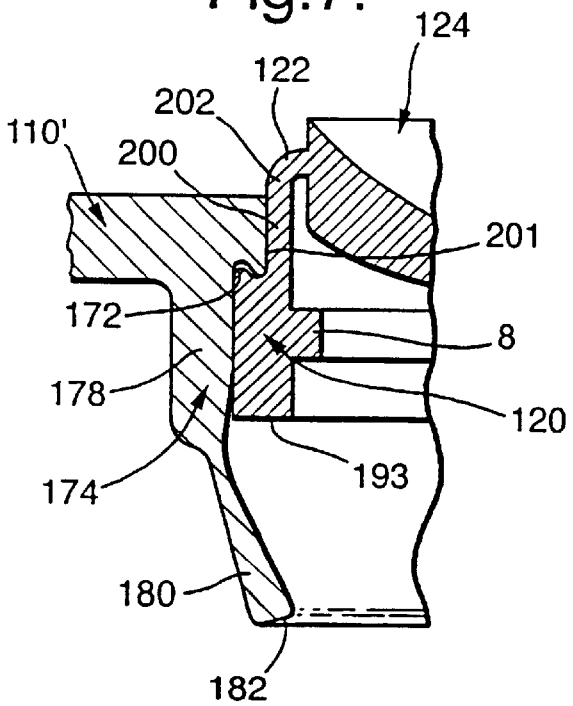
FIG. 7 shows part of FIG. 5 in a modification of the second closure.

FIG. 7 shows a variation of the embodiment of FIG. 5 and 6, in which the closure body, now referenced 110', is dimensioned to make an interference fit with a lower part 200 of the connecting wall 122 of the valve 112. For that purpose it extends upwardly from the inclined abutment face 172 as a cylindrical surface 201.

The degree of interference between the surface 201, and the wall portion 200 is typically 0.1 mm on diameter, and because of the constraint which is imposed on the valve, any tendency for its mounting ring 120 to become locally dislodged from proper sealing engagement with the closure body (e.g. during cleaning) is substantially reduced. An upper part of the connecting wall, denoted 202 in the drawing, is left free of the closure body to allow the valve a necessary degree of freedom so that its head 124 can expand radially when the dispensing aperture is required to open for dispensing product.

The self-closing valves 12, 112 are designed with a view to minimising their material content and their cost of manufacture. In particular, because their connecting walls 22, 122 are generally cylindrical and axially directed, their valve heads are constrained to stay in substantially the same bodily positions during dispensing and afterwards. The invention may, however, be applied to self-closing valves of which the length of the connecting wall can vary to axially advance and retract the dispensing head as the internal pressure of the associated container is increased or decreased. Thus it may be used with self-closing valves of which the connecting wall includes a rolling diaphragm, or which alternatively provides a bistable operating characteristic as is disclosed in our copending International Patent Application No. PCT/GB98/02230 (Agents Ref. 4981WO).

We claim:

1. A method of securing a self-closing valve (12,112) having a mounting ring (20,120) in the assembly of a dispensing closure, the method being characterised by the following steps:

a) providing a closure body (10,110) with a downwardly directed abutment face (72,172) surrounding a dispensing aperture (68,168) in which the valve is to be located, and a generally cylindrical, skirt (74,174) dimensioned to accept the mounting ring and extending downwardly of the closure to a free edge (82,182) axially spaced from the abutment face, a portion (80, 180) of the skirt including the free edge (82,182) being inwardly deformable;

b) providing the mount ng ring (20,120) of the self-closing valve (12,112) with an upwardly directed abutment face (30,130) engageable with the/abutment face (72,172) of the closure body (10,110);

c) entering the valve (12,112) into the skirt (74,174) of the closure body (10,110) with the abutment faces (30,72 and 130,172) in opposition; and d) inturning deformable portion (80,180) of the skirt (74,174) against the mounting ring (20,120) so that it holds the mounting ring with the abutment faces (30,72 and 130,172) in mutual abutment and with the closure body (10,110) and the valve (12,112) in sealing relation.

2. The method as defined in claim 1 wherein step (c) is carried out by moving the self-closing valve (12, 112) through the dispensing aperture (68, 168) in the same direction as the product flow for dispensing.

3. The method as defined in claim 1 wherein step (d) is carried out by a mandrel (90) which is lifted against the deformable portion (80, 180) of the skirt (74, 174).

4. The method as defined in claim 3 wherein in step (d) the mandrel (90) has first and second parts (90B, 90C) arranged to operate in succession on the deformable portion (80, 180) of the skirt (74, 174).

5. The method as defined in claim 3 wherein the mandrel (90) includes a part (90A) which is arranged to provide outer restraint for the skirt (74, 174) while step (d) is taking place.

6. The method as defined in claim 3 wherein the mandrel (90) additionally engages the self-closing valve (12, 112) directly.

7. A dispensing closure on or for a container, which comprises a closure body (10,110) having a dispensing aperture (68,168), a downwardly directed abutment face (72,172) surrounding the aperture, and a generally cylindrical skirt (74,174) extending downwardly of the closure to a free edge (82,182) which is spaced from the abutment face, the closure further comprising a self-closing valve (12,112) having a mounting ring (20,120) formed with an upwardly directed abutment face (30,130), the valve (12,112) being received within the skirt (74,174) with its abutment face (30,130) abutting the abutment face (72,172) of the closure body (10,110,110') and held there by an inturned and resilient portion (80,180) of the skirt (74,174) including the free edge (82,182) thereof, the closure body (10,110,110') and the valve (12,112) being disposed in sealing relation.

8. The dispensing closure as defined in claim 7 wherein the closure body (10, 110, 110') and the valve (12, 112) form a seal at the engagement of their abutment faces (72, 30 and 172, 130).

9. The dispensing closure as defined in claim 7 wherein the abutment face (72, 172) of the closure body (10, 110) is formed on the underside of a tapering lip (70, 170).

10. The dispensing closure as defined in claim 9 wherein a free edge of the lip (70, 170) engages the connecting wall (22, 122) of the valve (12, 112).

11. The dispensing closure as defined in claim 7 wherein the closure body (110') has a substantially cylindrical surface (201) which extends upwardly from the abutment face (172) in engagement with a lower part (200) of the connecting wall (122) of the valve (112).

12. The dispensing closure as defined in claim 7 wherein the closure body (110, 110') engages the mounting ring (120) of the valve (112) at a cylindrical interface.

13. The dispensing closure as defined in claim 12 wherein a seal is formed at the cylindrical interface.

14. The dispensing closure as defined in claim 7 wherein the upper portion (78, 178) of the skirt (74, 174) is adapted to make sealing engagement in the mouth of the associated container.

15. The dispensing closure as defined in claim 7 wherein the connecting wall (22, 122) of the valve (12, 112) is generally cylindrical.

16. The dispensing closure as defined in claim 7 wherein the inturned portion (80, 180) of the skirt (74, 174) is circumferentially continuous.

* * * * *